United States Patent [19]

Cavagna

[11] 4,191,335

[45] Mar. 4, 1980

[54] DRY REFINING PROCESS AND APPARATUS

[75] Inventor: Giancarlo A. Cavagna, Silver Spring, Md.

[73] Assignee: Westvaco Corporation, New York, N.Y.

[21] Appl. No.: 1,428

[22] Filed: Jan. 8, 1979

[51] Int. Cl.[2] ..... B09C 7/02

[52] U.S. Cl. ..... 241/17; 241/18; 241/28; 241/261.2; 241/261.3

[58] Field of Search ..... 241/15, 17, 18, 23, 241/28, 57, 60, 244, 260, 261.2, 261.3

[56] References Cited

U.S. PATENT DOCUMENTS

| | | | |
|---|---|---|---|
| 1,795,603 | 3/1931 | Hussey | 241/261.3 X |
| 3,596,840 | 8/1971 | Blomquist et al. | 241/28 |
| 3,802,630 | 4/1974 | Lee et al. | 241/18 |

*Primary Examiner*—Richard B. Lazarus

[57] ABSTRACT

A process and apparatus is disclosed for dry refining cellulosic pulp wherein the liberated fibers are structurally deformed and twisted without producing unwanted knots or fiber bundles. For the purposes of the invention, a disk refiner is used which is modified to include one or more air jets located at the periphery of the refiner housing. During refining, the refiner is provided with a cooling means, while air is introduced into the housing through the air jets to prevent fibers from becoming trapped between the ends of the refiner disks and the housing walls, thus preventing the formation of knots and fiber bundles.

5 Claims, 4 Drawing Figures

DRY REFINING PROCESS AND APPARATUS

BACKGROUND OF INVENTION

The present invention relates generally to the refining of cellulosic pulp, and more particularly, to a dry refining process and apparatus wherein the liberated fibers are structurally deformed and twisted without producing knots or fiber bundles.

Cellulosic fibers must be subjected to mechanical treatment before they can be made into paper. This treatment may be applied in a number of different ways, but it generally includes a bruising, rubbing or crushing action on the fibers. The terms beating and refining are used in the paper industry to describe the operation of mechanically treating pulp fibers. Refining usually refers to a fiber separation and fiber cutting action, whereas beating action may include these two effects, and also a fibrillating or bruising effect on the fiber. The amount and type of mechanical treatment used on the pulp contributes to the final pulp properties including burst, tensile strength, density, bulk, freeness and formation. In this regard, dry refining with a disk refiner is alleged to be effective treatment for enhancing some of the above noted properties of pulp. Dry refining may be defined as subjecting pulp to a refining action at a solids content in excess of about 85%.

In disk refining, the pulp generally enters the refiner housing through an opening near the center of one disk, passes into a central feeding chamber, and then passes outward between the disks where it is discharged at the periphery of the housing. Pulp throughput is controlled by the amount of material introduced into the refiner while the gap or space between the disk plates determines the amount of work or energy expended on the pulp. After refining, the pulp falls by gravity through an exit at the periphery of the refiner. The units may be of the single rotation type (with one stationary and one rotating disk), the double rotation type (with two rotating disks), or of the double disk type (two stationary disks and one double sided rotating disk). The distance between the disks is generally greater near the central part and successively decreases outwards into a narrow gap between the disk plates which have generally parallel sides along the outer parts of the disks. Pulp is conducted by centrifugal forces from the feeding chamber outwards through the gap between the disk plates where the pulp is subjected to the refining action. Thus, as the pulp passes between the refiner disks, the fibers are liberated and treated to a twisting and kinking action. However, experience has shown that dry refining using conventional disk refining equipment also produces unwanted fiber bundles and knots.

To offset this problem, it is proposed in U.S. Pat. No. 3,596,840, to Blomqvist et al, to introduce pulp into a disk refiner entrained in a carrier gas stream. In doing so, it is alleged that the number of fiber bundles or knots produced are reduced to about 10–15 percent. However, there is no information provided to show the amount of work done on the fibers in Blomqvist et al, and it is apparent that little fiber deformation or separation is accomplished since the pulp passes rapidly through the gap between the disks. Meanwhile, in U.S. Pat. No. 4,036,679, to Back et al, another dry refining process using a disk refiner is disclosed wherein the throughput rate is correlated with the rate of relative movement of the disks to produce convoluted, twisted, fiberized fibers which are nonfibrillated. In the latter patent, no carrier gases are used nor specifically required, and there is no information provided to show how many knots or fiber bundles are produced.

In contrast to the prior efforts noted above, the present invention is based on the belief that fiber bundles and knots are produced by an increase in the temperature of the refiner during operation, and because the individual fibers sometimes become lodged in the refiner where they receive excessive energy. Thus, the process and apparatus of the present invention treats cellulose pulp to produce fibers that are substantially permanently deformed, i.e., twisted, kinked and bent, but without producing unwanted fiber bundles and knots.

SUMMARY OF INVENTION

In the process of the present invention, low moisture content pulp (in excess of about 85% solids content), is fed continuously into and through a work space formed between the opposed, spaced apart working elements of a disk refiner. The working elements include opposed surfaces capable of applying contortive and fiber separating forces to the pulp by engaging the fibers under controlled conditions. However, as the fibers become liberated, it has been found that they sometimes become lodged between the housing walls and the ends of the disks. This phenomena is believed to be responsible for the production of unwanted knots and fiber bundles, since, while the fibers remain entrapped in the space between the ends of the disks and the housing, additional energy is expended on the fibers. This action also increases the operating temperature of the refiner and produces an entanglement of the fibers which become fused into knots and fiber bundles.

In order to relieve the above noted conditions while still obtaining the desired refining action which occurs between the refiner disks, the present invention incorporates two improvements. First, one or more air jets are arranged on the refiner housing at the periphery of the refiner disks where air can be introduced to prevent any build up of fibers in the space between the outer edges of the disks and the housing and, secondly, a suitable means is provided in conjunction with the refiner for keeping the refiner relatively cool during operation. For the latter purpose, the air introduced into the refiner through the air jets can be chilled or other internal cooling means can be introduced into the refiner housing or disks as a recirculating cooling medium such as water or a gas.

DETAILED DESCRIPTION

Figure 1:
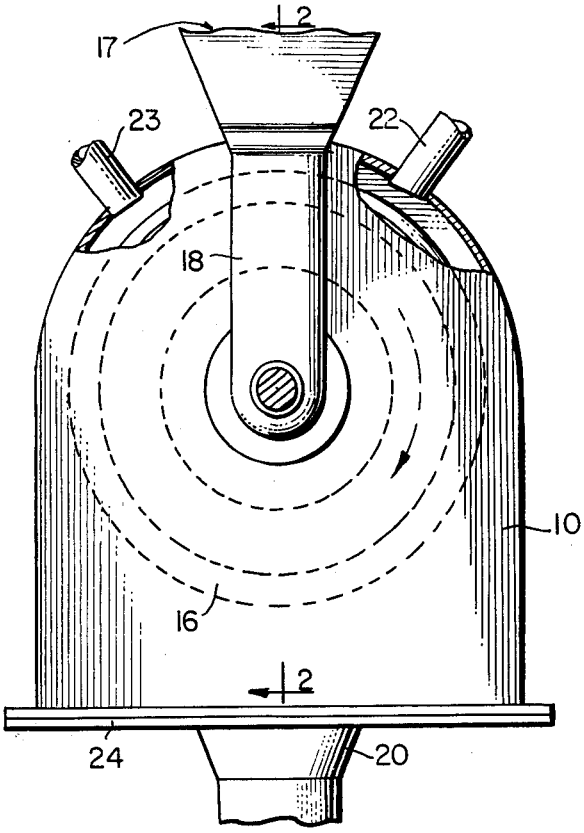
FIG. 1 is an end view showing schematically a typical disk refiner modified according to the present invention.

The basic concepts of the present invention are illustrated schematically in the drawing wherein FIG. 1 shows a typical disk refiner, including a housing 10, a pulp receiving hopper 17 and a pulp feeding passage 18. The refiner is mounted on a suitable platform 24 and also includes a discharge conduit 20. For the purposes of the present invention, the refiner has mounted on the periphery thereof a pair of air inlet pipes or jets 22,23 for introducing an air flow into the refiner as more fully described hereinafter.

Figure 2:
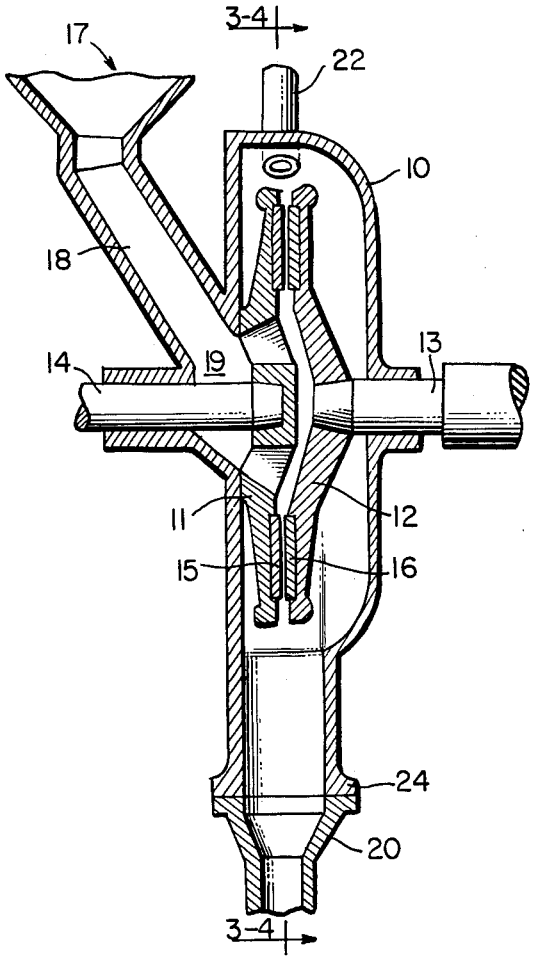
FIG. 2 is a cross sectional view of the refiner taken along the lines 2—2 in FIG. 1.

The cross section shown in FIG. 2 illustrates the refiner housing 10, hopper 17 and feed passage 18 which leads to a feed chamber 19. The feed chamber is located near the center of the refiner and serves as a distribution point for the pulp entering the working space between a stationary disk 11 mounted on shaft 14, and a rotating disk 12 mounted on shaft 13. Meanwhile, the working face of each disk 11,12 is provided with an annular plate 15,16 between which the pulp fibers pass during refining.

In the operation of the refiner, the annular plates 15,16 are spaced apart an amount of from about 0.025 to 0.040 inch for best results. This degree of spacing is within the range where conventional disk refiners are operated but is less than the prescribed spacing of from 0.04 to 0.10 inch prescribed by the Back et al patent mentioned hereinbefore for producing convoluted, twisted fibers. Thus, as the pulp is constrained to move outward between the plates 15,16, the action of disk 12 rotating opposite fixed disk 11 produces a rapid rolling of the fiber bundles and a separation of the fibers under the influence of centrifugal force. As a result of the pressure and gravity influences in the refiner 10, the separated fibers which are discharged peripherally from between the plates 15,16 tend to move to the lower part of the refiner and to the exit 20. However, experience has shown that the fibers collect and become trapped between the ends of the disks 11,12 and the walls of the refiner 10. When this action occurs, the fibers receive more work, heat and pressure than desired, and as a consequence thereof become bound together in unwanted fiber bundles and knots. In some instances the refiner becomes clogged, and the heat built up may even cause fires.

Figure 3:
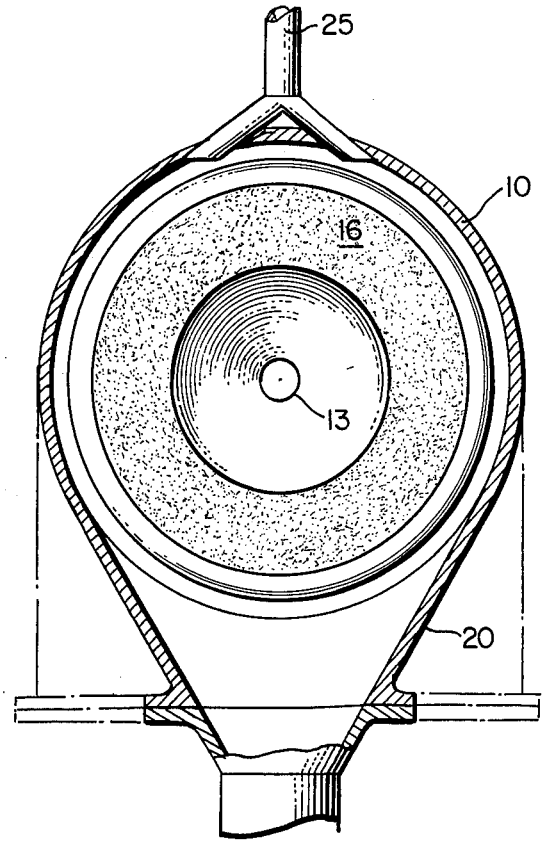
FIG. 3 is a cross sectional view taken along the lines 3—3 of FIG. 2 showing schematically an alternative embodiment according to the present invention; and, FIG. 4 is a cross sectional view taken along the lines 4—4 of FIG. 2 showing schematically another alternative embodiment according to the present invention.
Figure 4:
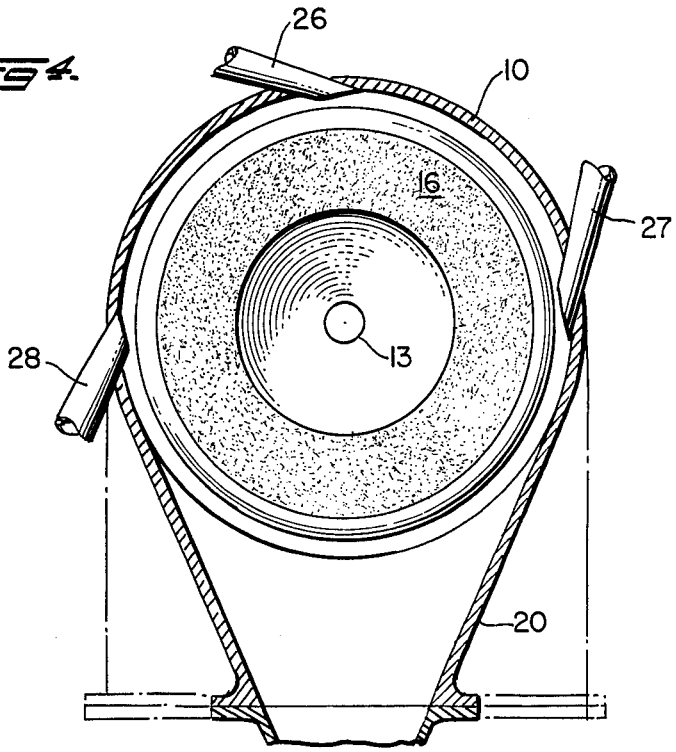

Accordingly, in order to overcome the aforementioned problems while still yielding a properly refined pulp with the desirable twisted and kinked fibers, the present invention encompasses two improvements. Namely, the addition of air jets as shown at 22,23 at the periphery of the refiner for introducing air into the areas of the refiner where the fibers tend to become trapped, and, the inclusion of a means in conjunction with the refining action for keeping the refiner cool during operation. In this regard, FIGS. 3 and 4 illustrate alternative embodiments showing different locations for the air jets. For instance, a single air jet 25 that is split into two streams could be incorporated in the refiner as shown in FIG. 3, while as shown in FIG. 4, the air jets 26,27,28 may be equally spaced around the refiner housing. Meanwhile, for cooling the refiner, any well known technique could be employed, including the use of cool air in the various air jets 22,23 or 25, or 26,27,28. Alternatively, a cooling gas or fluid medium could be circulated through one or both of the disks 11 and 12, or around the refiner housing 10. The specifics of the latter alternatives are not deemed to be an essential part of the present invention since they are within the knowledge of a person skilled in the appropriate art.

Notwithstanding, in order to demonstrate the efficiency of the process and apparatus of the present invention the following Examples are offered.

EXAMPLE I

A sample of baled hardwood pulp was treated with a disk refiner modified as shown schematically in FIG. 1. The pulp was dried to about 92% solids and passed through the refiner at two different gap settings. For each gap setting, two samples were obtained, one without air flow into the air jets and the other with an an air flow of about 50 psi. After the samples were treated, they were formed into handsheets according to TAPPI standards and evaluated for knot production. The results are shown in Table I.

Table I

| Knot Development | | | |
|---|---|---|---|
| Sample | Disc Gap inch | Air | Knots |
| 1 | .025 | No | 10–15 |
| 2 | .025 | Yes | 0–1 |
| 3 | .040 | No | 0–1 |
| 4 | .040 | Yes | 0–1 |

In each case, the number of knots were counted in an area one inch in diameter on the handsheet. As shown by the data, the pulp sample treated at the 0.025 inch gap setting produced fewer knots with the air flow. Moreover, the pulp samples treated at the 0.025 inch gap setting contained fibers with substantially greater twists and kinks than the pulp treated at the 0.040 inch gap setting. Thus, while the pulp treated at the 0.040 inch gap setting contained substantially no knots with or without the air jets in use, the treatment of the pulp at the higher gap setting did little if any work on the fibers. In addition, the amount of air pressure utilized did not play a significant role in reducing knots, as long as the pressure was sufficient to keep the pulp fibers from becoming entrapped between the disks and housing.

EXAMPLE II

A second batch of baled hardwood pulp was treated substantially as disclosed in Example I to observe the effects of temperature on the development of knots. In each case, the air jets were used to minimize the development of knots, while the gap setting and temperature were varied. Once again TAPPI handsheets were prepared and examined for knot production substantially as set forth in Example I. The results are shown in Table II.

Table II

| Temperature Effects | | | | |
|---|---|---|---|---|
| | | Temperature | | |
| Condition | Disc Gap Inch | Before °F. | After °F. | Knots |
| 1 | .025 | 75 | 95 | 10–15 |
| 2 | .025 | 75 | 107 | 10–12 |
| 3 | .030 | 75 | 95 | 0–1 |
| 4 | .030 | 180 | 175 | 30–40 |

In conditions 1 and 2, insufficient air flow was used to keep the refiner from becoming plugged. Accordingly, although the refiner was kept relatively cool, the number of knots produced was excessive. In fact, in condition 2, the pulp began to burn. Meanwhile, conditions 3 and 4 were run with additional air flow so that only the effects of temperature were variable. Thus, as shown by the data in conditions 3 and 4, keeping the refiner relatively cool produced substantially no knots at a constant gap setting.

Accordingly it may be seen that the present invention provides a simple and effective method for reducing knot formations during dry refining while still producing a refined pulp with desireably twisted and kinked fibers. Moreover, while the invention has been described only schematically with respect to the different elements that may be used, it nevertheless is fully described and should be measured only by the scope of the appended claims.

I claim:

1. Method for dry refining cellulosic fibrous material to produce convoluted, fiberized cellulose fibers which are twisted and bent in a substantially lasting manner without producing knots or fiber bundles comprising, introducing the fibrous material in a substantially dry state into a refiner housing having opposed disk refining surfaces, flowing said material between the relatively opposed refining surfaces located within said refiner housing, causing one or more of said refining surfaces to rotate relative to other refining surfaces so as to operate on said material and liberate the individual fibers thereof as the material flows between said surfaces and removing the liberated fibers from the refiner housing, the improvement wherein, during the refining action, one or more sources of air is introduced into the refiner housing at the periphery thereof in the region between the ends of the milling disks and the refiner housing walls to prevent the liberated pulp fibers from becoming trapped between the ends of the refining surfaces and the refiner housing walls while maintaining the refiner in a relatively cool condition.

2. The method of claim 1 wherein the fibrous material is introduced into the refiner housing at a solids content of at least about 85%.

3. The method of claim 2 wherein the air is introduced at the periphery of the refiner housing at a pressure sufficient to prevent a build up of liberated fibers between the ends of the refining disks and the refiner housing walls.

4. The method of claim 3 wherein the refiner is maintained at or near room temperature during operation.

5. Apparatus for dry refining cellulosic fibrous material without producing knots or fiber bundles comprising, a refiner housing, at least one fixed milling disk and at least one rotatable milling disk mounted in said housing in face-to-face relation, an inlet means for feeding substantially dry fibrous material into said housing, means for directing said fibrous material between said milling disks and an outlet for removing the refined fibrous material from said housing, the improvement comprising, the inclusion of one or more nozzles located on the periphery of said housing means for introducing air into the housing through said one or more nozzles in the region between the ends of said milling disks and said refiner housing walls and means associated with said refiner for keeping the refiner relatively cool during operation.

* * * * *